United States Patent [19]

Wait et al.

[11] 4,300,694

[45] Nov. 17, 1981

[54] HINGED PALLET BOX

[75] Inventors: Hershey L. Wait, Lake Zurich; Edward S. Kordowski, Chicago, both of Ill.

[73] Assignee: General Box Company, Toledo, Ohio

[21] Appl. No.: 114,117

[22] Filed: Jan. 21, 1980

[51] Int. Cl.[3] ..... B65D 6/20
[52] U.S. Cl. ..... 217/43 R; 217/48
[58] Field of Search ..... 217/43 R, 48

[56] References Cited

U.S. PATENT DOCUMENTS 937,880 10/1909 Smith ..... 217/48
2,110,150 8/1938 Hile ..... 217/43

*Primary Examiner*—George E. Lowrance
*Attorney, Agent, or Firm*—Richard D. Emch

[57] ABSTRACT

An improved pallet box having four sidewall assemblies and a floor assembly is disclosed. The sidewall assemblies are all joined together by means of two hinge connectors joined together by mating loops and fixed to the reinforcing cleats of each joined sidewall assembly.

6 Claims, 7 Drawing Figures

HINGED PALLET BOX

BACKGROUND OF THE INVENTION

The present invention is a pallet box utilizing an improved hinge assembly which enables the sidewall assemblies of the pallet box to collapse together to form a generally flat unit. Collapsible pallet boxes are known in the prior art and are desirable in that they can be shipped and stored in their flattened position to save on storage space and freight costs. They are also easy to disassemble and reuse, giving an increased use-life.

A prior art hinge assembly for collapsible pallet boxes is shown in FIGS. 6 and 7 of the drawings. The preformed interlocking wires create a hinge which support the sidewall assemblies yet allow the pallet box to fold flat when desired. In this prior art hinge assembly, however, there is a dearth of wood anchoring the hinge assembly and it is a relatively common phenomena to have the wood pull out and break under varying loading pressures and stress. Often it is necessary to add a metal plate to prevent this type of failure.

Another disadvantage of the prior art hinge assembly shown in FIGS. 6 and 7 lies in the inability to easily replace the hinge assembly should it break. The only way to achieve replacement of the broken hinge assembly is to cut all the wires and remove the broken pieces. The replacement assembly must be looped together before inserting it through the cleats and this requires separating the adjacent edges of the sidewall assemblies enough to set the looped wires in place. The hinge assembly of the present invention greatly eases the replacement process.

SUMMARY OF THE INVENTION

The present invention is generally directed to pallet boxes, and particularly to an improved hinge assembly for joining the sidewall assemblies, thereby strengthening the pallet box when in use and giving added flexibility for storage when not in use.

The pallet box of the present invention comprehends a four-sided enclosure having four sidewall assemblies joined at their adjacent vertical edges. Adjacent the bottom edge of the four-sided enclosure is a floor assembly. The sidewall assemblies are joined at their adjacent vertical edges by a plurality of hinge assemblies, each having two units interjoined by mating loops. The first units and the second units are all anchored to the cleats on an axis perpendicular the plane of their respective sidewalls. Such a perpendicular connection establishes straight line forces along the legs of each connector when the pallet box is loaded and in a stress condition and eliminates many of potential forces which shear the wooden cleats and cause the wire connectors to pull out.

The interjoined loops of the two wire connectors give the sidewall assemblies great flexibility to fold together and apart, covering substantially a 180° angle, and allowing the pallet box to fold flat for easy efficient storage. Because the corners are all alike, the pallet box of the present invention will fold in either direction (see FIG. 3). This is an improvement over prior art collapsible pallet boxes which normally folded only in one direction.

It is the primary object of this invention to provide an improved hinged pallet box which can be stored efficiently and assembled with a minimum of effort.

Another object of this invention is to provide an improved hinge assembly for the corners of a foldable pallet box.

Still another object of this invention is to provide a hinge assembly which gives a more extensive use-life to the pallet boxes on which it is employed.

Still another object of this invention is to provide ease in effecting replacement of broken hinge assemblies.

DESCRIPTION OF THE PREFERRED EMBODIMENT

Figure 1:
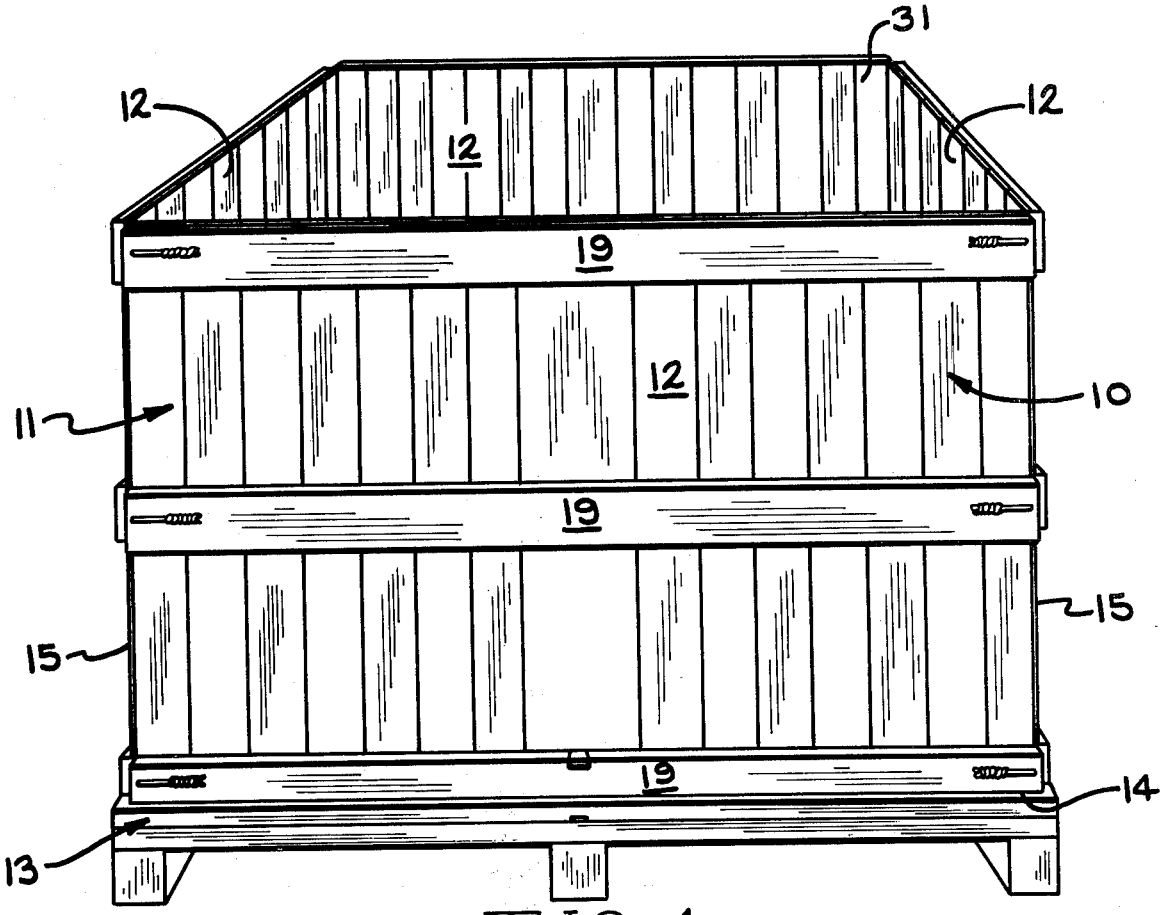
FIG. 1 is a perspective view of the improved hinged pallet box in accordance with the present invention.
Figure 2:
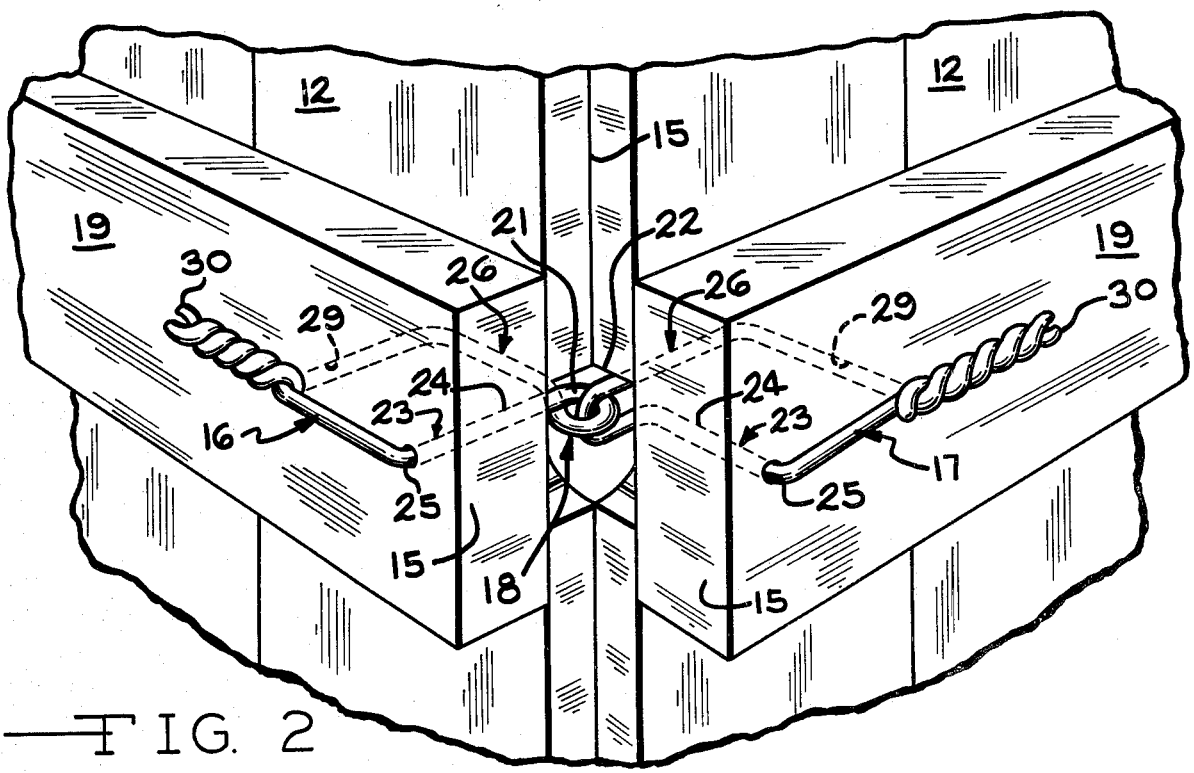
FIG. 2 is a detailed fragmentary view showing the interconnection of the first and second wire connectors and their respective cleats.

The improved pallet box 10 of the present invention comprehends a four-sided enclosure 11 having four sidewall assemblies 12. A floor assembly 13 is joined to a bottom edge 14 of the connected four sidewall assemblies 12. The four sidewall assemblies 12 are joined together at their adjacent vertical edges 15 by hinge assemblies 18 which include a first connector unit 16 and a second connector unit 17 joined together by mating loops 21 and 22. The units 21 and 22 are normally formed of metal wire or rods.

In the preferred embodiment, the first unit 16 and the second unit 17 of the hinge assembly 18 are anchored in the cleats 19 of the side-wall assemblies 12. The first units 16 are interjoined with the second units 17 by the mating loops 21 and 22. The first mating loop 21 is a closed loop and the second mating loop 22 is an open loop which connects through the closed first mating loop 21 and is generally perpendicular to the first mating loop 21.

The first units 16 and the second units 17 each include a first leg 23 having a portion 24 extending from the mating loops 21 or 22 and received by an opening 25 in the cleat 19. The opening 25 in the cleat 19 extends through the sidewall assembly 12 and is generally perpendicular to the sidewall assembly.

The first units 16 and the second units 17 each also include a second leg 26. The second leg 26 has a portion 27 which extends from the mating loops 21, 22 and is generally perpendicular to the first leg portion 24. The second leg portion 27 extends parallel to and adjacent the surface 20 of the sidewall assembly 12 for a predetermined distance 28. In the preferred embodiment this distance 28 is 1.5 inches, however, the distance 28 may be as narrow as 0.75 inches. After attaining the specified distance 28 from the mating loops 21, 22, the second leg 26 is inserted through a second opening 29 in the sidewall assembly 12. The second opening 29 is parallel to the first opening 25. The first leg 23 and the second leg 26 extend through the sidewall assembly 12 parallel to and spaced the predetermined distance 28 from each other.

It has been found that the predetermined distance 28 between the first leg 23 and second leg 26 is a function of the strength of the cleat 19 material and the actual thickness of the sidewall assembly 12. The stronger the cleat 19 material and the thicker the sidewall assembly 12, the less distance is required between the first opening 25 and the second opening 29. The minimal distance required to maintain desired strength is, as noted above, normally 0.75 inches.

The distal ends 30 of the first leg 23 and the second leg 26 are joined together to anchor the first unit 16 and the second unit 17 to the sidewall assemblies 12, thereby forming the hinge assembly 18 which joins the sidewall assemblies 12 together to form the four-sided enclosure 11. In the preferred embodiment, the distal ends 30 are twisted together and flattened against the surface of the sidewall assembly 12. It is understood that the distal ends 30 may be joined in many differing fashions and located in positions other than those shown in the drawings. In FIG. 1, the twisted ends 30 extend inwardly along the cleats 19, however, in many instances it is preferable to bend the twisted ends outwardly toward the vertical edges 15.

Figure 3:
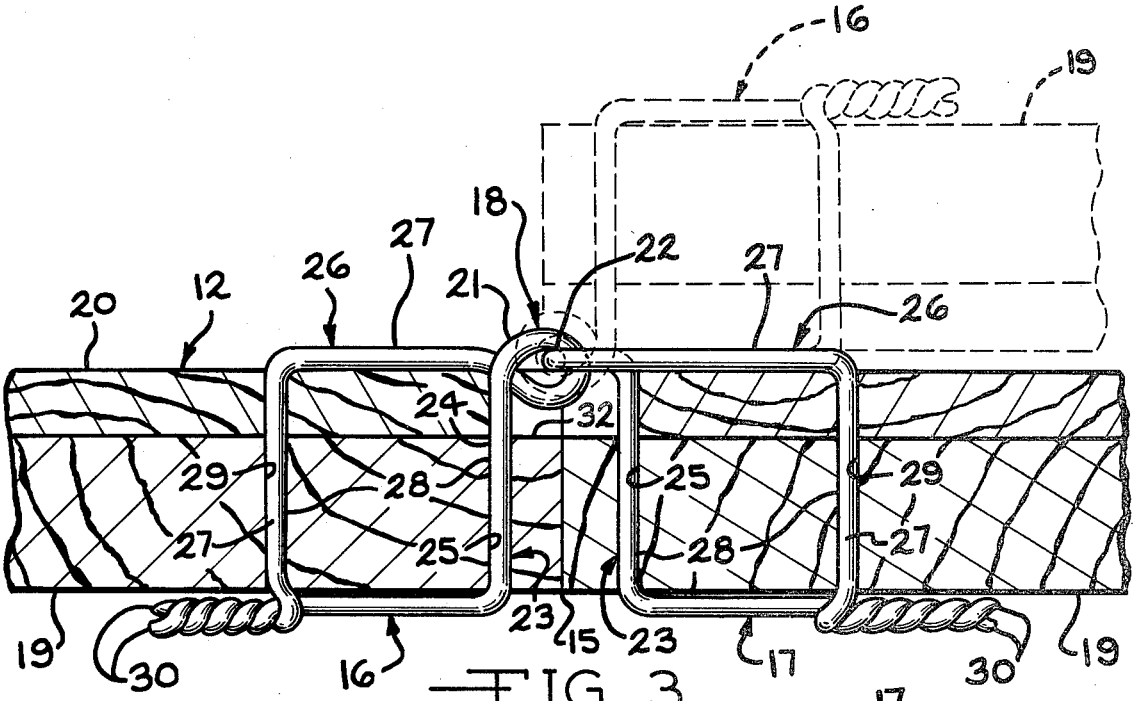
FIG. 3 is a fragmentary view showing the corner hinge assembly pivoted to its flat position, with another position of the first wire connector being shown by dashed lines.
Figure 4:
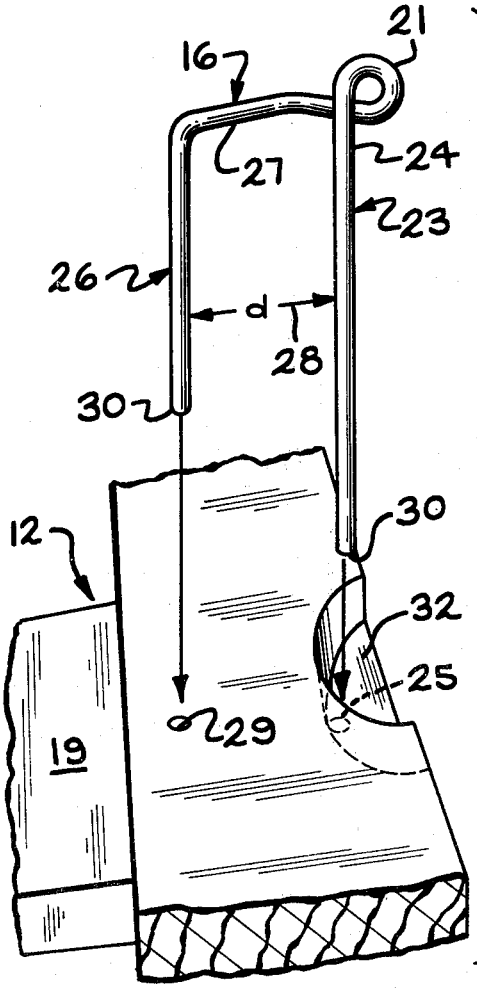
FIG. 4 is a fragmentary view showing the insertion of the first connector unit through passageways in a cleat and sidewall assembly.
Figure 5:
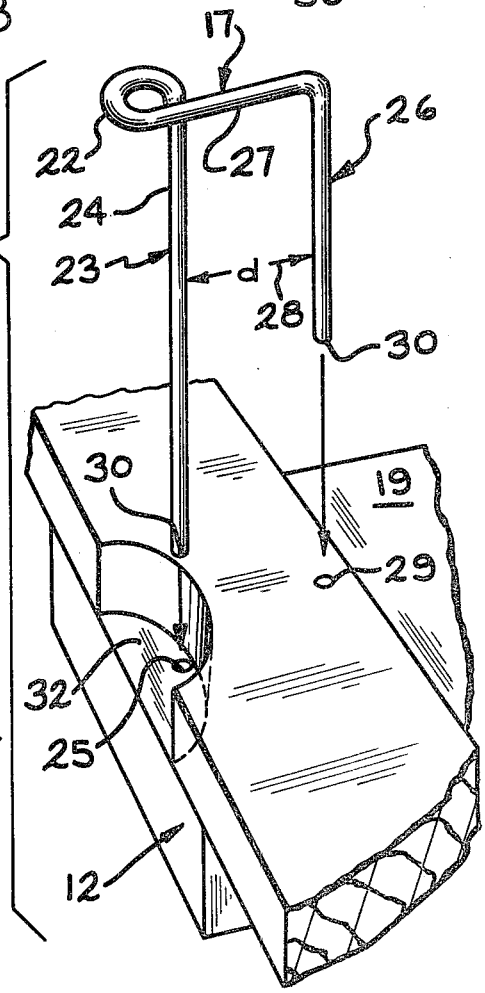
FIG. 5 is a fragmentary view showing the insertion of the second connector unit through passageways in a cleat and sidewall assembly.
Figure 6:
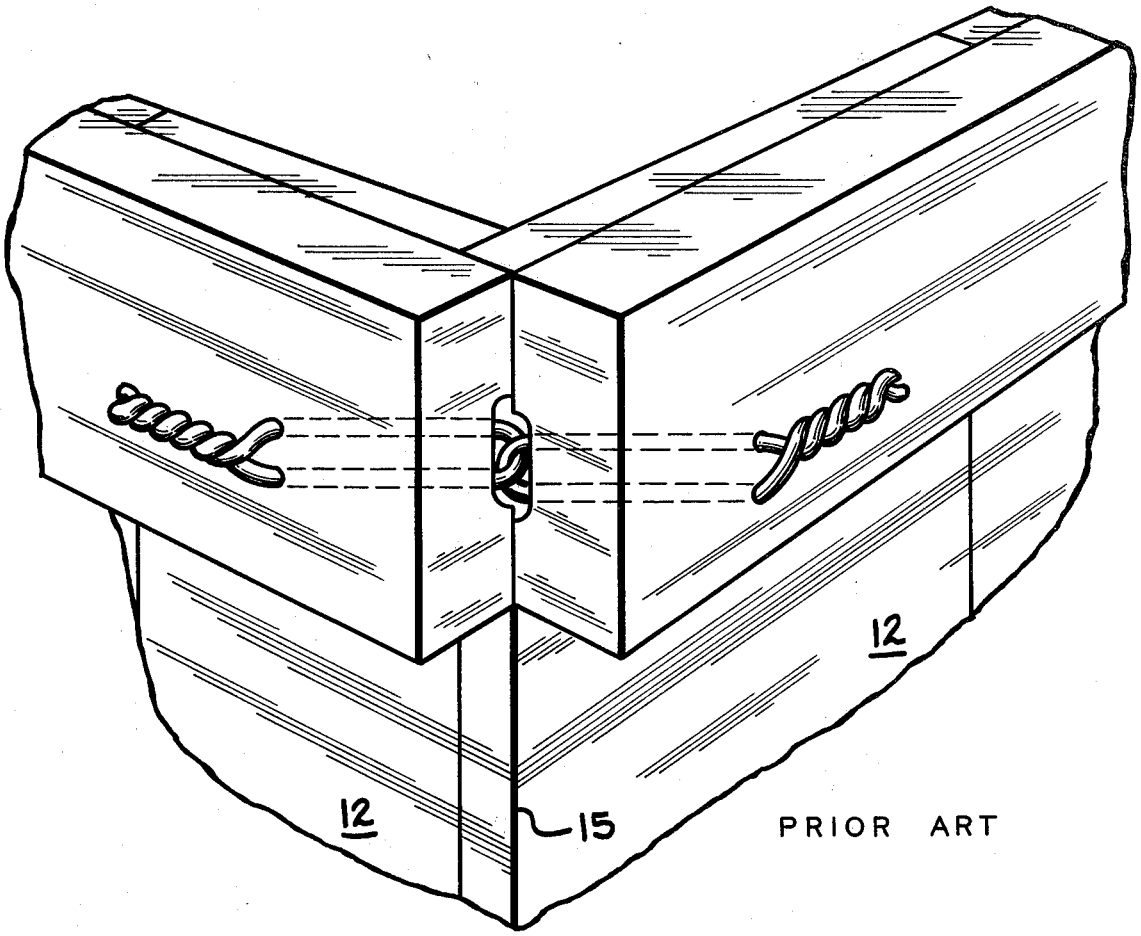
FIG. 6 is a fragmentary view showing a hinge assembly known to be prior art.
Figure 7:
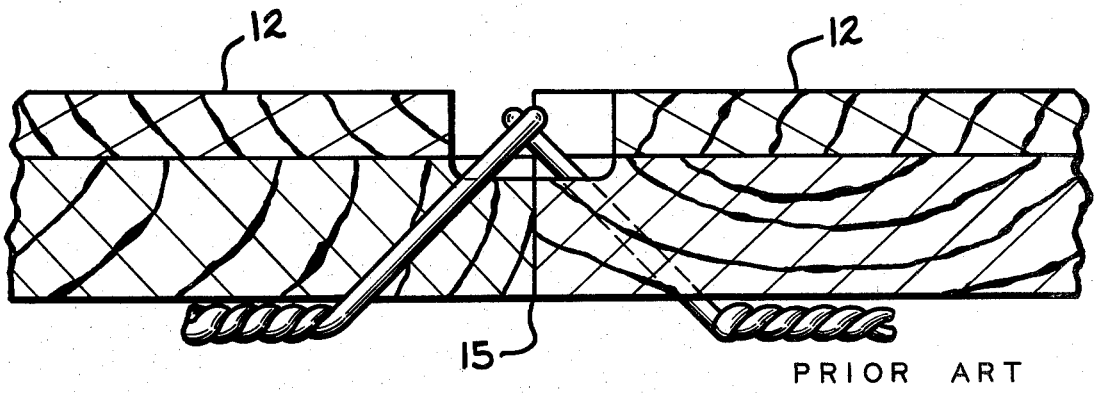
FIG. 7 is a fragmentary top view showing the prior art hinge assembly of FIG. 6.

In the preferred embodiment, the inside surface of each sidewall assembly 12 has indents 32 as shown in FIGS. 3, 4 and 5. Each indent 32 is adjacent a pair of mating loops 21, 22 to enable the interjoined mating loops 21, 22 to fit flush within the corner formed by the connected sidewall assemblies 12. Thus any obstruction on the interior of the four-sided enclosure is alleviated.

It will be appreciated that other arrangements of the improved hinged pallet box may be used and other changes may be made in the varying assemblies without departing from the scope of the appended claims.

What I claim is:

1. An improved hinged collapsible pallet box comprising, in combination, a plurality of sidewall assemblies said sidewall assemblies each including a side panel and reinforcing cleats, said side panel having an outer surface, said cleats terminating adjacent said edges of said side panel, a first and second opening defined in said side panel and reinforcing cleat, said first and second openings being positioned substantially perpendicular to said surface of said side panel, said first and second openings being substantially parallel and spaced apart, first and second hinge assemblies joined together by mating loops, said first and said second hinge assemblies each including a first leg extending from said mating loops and positioned in said first opening and extending generally perpendicularly with respect to said surface of said side panel, and a second leg having a first portion extending from said mating loop parallel to and adjacent said side panel and reinforcing cleat, said second leg having a second portion extending through said second opening in said side panel and reinforcing cleat, the distal ends of said first and second legs extending through said first and second openings being joined together to secure said first and second hinge assemblies to said sidewall assemblies.

2. An improved hinged pallet box as described in claim 1, wherein said mating loops comprise a closed loop integral with said first unit and an interjoining open loop integral with said second unit.

3. An improved hinged pallet box as described in claim 2, wherein said closed loop is substantially perpendicular to said open loop.

4. An improved hinged pallet box as described in claim 1, wherein said side wall assemblies define indents adjacent each of said open and closed mating loops, said indents receiving said mating loops.

5. An improved hinged pallet box as described in claim 1, wherein said second leg extends through said said panel a predetermined distance from said first let portion, said predetermined distance being at least 0.75 inches.

6. A hinge for a collapsible box comprising:

a plurality of sidewall assemblies positioned with the edges of adjacent sidewall assemblies being adjacent, said sidewall assemblies including a side panel and at least one reinforcing cleat, said cleat terminating adjacent said edges of said sidewall assembly;

a first opening passing through said side panel and said cleat adjacent said edges of said sidewall assembly, said first opening being substantially perpendicular to the longitudinal axis of said cleat;

a second opening passing through said side panel and said cleat, said second opening being substantially parallel to said first opening, said second opening being spaced apart from said first opening and said edges of said sidewall assembly;

a first hinge member positioned on a sidewall assembly, said hinge member having a first leg, a second leg and a closed loop formed at the juncture of the first and second legs, said first leg extending through said first opening and said second leg extending through said second opening whereby said closed loop is positioned adjacent said edge of said sidewall assembly, said ends of said first and second legs extending through said first and second opening being connected together to secure said first hinge member to said sidewall assembly; and a second hinge member positioned on an adjacent sidewall assembly, said second hinge member having a first leg, a second leg and an open loop formed at the juncture of said first and second legs, said open loop being positioned in said closed loop of said first hinge member to form a hinge between said adjacent sidewall assemblies, said first leg of said second hinge assembly extending through said first opening and said second leg extending through said second opening whereby said open loop is positioned adjacent said edge of said sidewall assembly, said ends of said first and second legs extending through said first and second openings being connected together to secure said second hinge member to said sidewall assembly.

* * * * *